US010260518B2

(12) United States Patent
Zheng

(10) Patent No.: US 10,260,518 B2
(45) Date of Patent: Apr. 16, 2019

(54) DOWNHOLE ELECTRICAL SUBMERSIBLE PUMP WITH UPTHRUST BALANCE

(71) Applicant: Halliburton Energy Services, Inc., Houston, TX (US)

(72) Inventor: Dezhi Zheng, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 309 days.

(21) Appl. No.: 15/318,399

(22) PCT Filed: Jul. 24, 2014

(86) PCT No.: PCT/US2014/047975
§ 371 (c)(1),
(2) Date: Dec. 13, 2016

(87) PCT Pub. No.: WO2016/014059
PCT Pub. Date: Jan. 28, 2016

(65) Prior Publication Data
US 2017/0122332 A1 May 4, 2017

(51) Int. Cl.
*F04D 29/08* (2006.01)
*F04D 13/08* (2006.01)
(Continued)

(52) U.S. Cl.
CPC ..... *F04D 29/086* (2013.01); *E21B 43/128* (2013.01); *F04B 47/06* (2013.01);
(Continued)

(58) Field of Classification Search
CPC ..... F04D 29/086; F04D 1/06; F04D 13/086; F04D 17/12; F04D 25/0686; F04D 29/22;
(Continued)

(56) References Cited

U.S. PATENT DOCUMENTS 8,568,081 B2 10/2013 Song et al.
2006/0269404 A1 11/2006 Volk
(Continued)

FOREIGN PATENT DOCUMENTS

WO 2010/036714 A2 4/2010

OTHER PUBLICATIONS

Extended European Search Report issued in related PCT Application No. PCT/US2014047975, dated Dec. 8, 2017, 7 pages.
(Continued)

*Primary Examiner* — Jacob Amick
(74) *Attorney, Agent, or Firm* — John W. Wustenberg; Baker Botts L.L.P.

(57) ABSTRACT

In accordance with embodiments of the present disclosure, a electrical submersible pump includes a pump housing, a shaft extending at least partially through the pump housing and adapted to be driven by a submersible motor, an impeller attached to the shaft and having an impeller passage for fluid to flow therethrough, and a diffuser that is stationary relative to the pump housing and having a diffuser passage, wherein the diffuser is disposed corresponding to the impeller to form a pump stage such that fluid can flow between the impeller passage and the diffuser passage. The electrical submersible pump also includes a labyrinth seal formed between the impeller and the diffuser, wherein the labyrinth seal selectively seals the impeller passage from a cavity formed between the impeller and the diffuser to maintain the impeller in a floating condition relative to the diffuser.

20 Claims, 9 Drawing Sheets

(51) Int. Cl.

| | |
|---|---|
| ***F04D 17/12*** | (2006.01) |
| ***F04B 47/06*** | (2006.01) |
| ***E21B 43/12*** | (2006.01) |
| ***F04D 1/06*** | (2006.01) |
| ***F04D 25/06*** | (2006.01) |
| ***F04D 29/22*** | (2006.01) |
| ***F04D 29/28*** | (2006.01) |
| ***F04D 29/42*** | (2006.01) |
| ***F04D 29/44*** | (2006.01) |

(52) U.S. Cl.
CPC ..... *F04D 1/06* (2013.01); *F04D 13/086* (2013.01); *F04D 17/12* (2013.01); *F04D 25/0686* (2013.01); *F04D 29/083* (2013.01); *F04D 29/22* (2013.01); *F04D 29/284* (2013.01); *F04D 29/4206* (2013.01); *F04D 29/426* (2013.01); *F04D 29/441* (2013.01); *F04D 29/445* (2013.01)

(58) Field of Classification Search
CPC .. F04D 29/284; F04D 29/083; F04D 29/4206; F04D 29/441; F04D 29/445; E21B 43/128; F04B 47/06
See application file for complete search history.

(56) References Cited

U.S. PATENT DOCUMENTS

| | | | | |
|---|---|---|---|---|
| 2008/0031731 | A1 | 2/2008 | Orban et al. | |
| 2011/0058965 | A1 | 3/2011 | Cunningham et al. | |
| 2012/0057970 | A1* | 3/2012 | Tingler | F04D 1/063 415/199.2 |
| 2013/0051977 | A1 | 2/2013 | Song et al. | |
| 2015/0260190 | A1* | 9/2015 | Bergamini | F04D 1/06 415/203 |
| 2017/0227012 | A1* | 8/2017 | Hirata | F04D 1/08 |

OTHER PUBLICATIONS

International Search Report and Written Opinion issued in related PCT Application No. PCT/US2014/047975 dated Apr. 27, 2015, 15 pages.

International Preliminary Report on Patentability issued in related Application No. PCT/US2014/047975, dated Feb. 2, 2017 (12 pages).

* cited by examiner

DOWNHOLE ELECTRICAL SUBMERSIBLE PUMP WITH UPTHRUST BALANCE

CROSS-REFERENCE TO RELATED APPLICATION

The present application is a U.S. National Stage Application of International Application No. PCT/US2014/047975 filed Jul. 24, 2014, which is incorporated herein by reference in its entirety for all purposes.

TECHNICAL FIELD

The present disclosure relates generally to well drilling and hydrocarbon recovery operations and, more particularly, to systems and methods for balancing the upthrust exerted on components of an electrical submersible pump.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

When producing and processing the hydrocarbons from the subterranean formation, an underground pump is often used to force fluids toward the surface. More specifically, an electrical submersible pump (ESP) may be installed in a lower portion of the wellbore and used to pressurize fluids, thereby sending the fluids toward the surface. Such ESPs typically include a series of alternating impellers and diffusers, the impellers being designed to rotate as rotors relative to the stationary diffusers. The rotating impellers increase the pressure of the fluids flowing therethrough. When fluids are pumped in this manner against relatively high pressure differentials, the momentum of the fluid may push the individual impellers against downstream diffusers in the series, which applies an undesirable upward thrust to various components of the ESP. This upward thrust, known herein as "upthrust", can reduce the overall lifespan of the ESP.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the invention.

Certain embodiments according to the present disclosure may be directed to an electrical submersible pump (ESP) that may be specifically designed for balancing an upward thrust (upthrust) on the impellers of the pump caused by pumping downhole fluids through the pump. Certain embodiments may include an ESP that has an electric motor for driving a shaft having centrifugal impellers distributed therealong. Each impeller is located adjacent a diffuser, which is stationary with regard to the pump wall, to form a multi-stage pump. Certain embodiments of the ESP may be useful in the petroleum industry, and especially useful for highly pressurized downhole pumping of fluid from wells drilled to produce fluid in the energy industry.

Certain embodiments may include a labyrinth seal formed between the impeller and corresponding diffuser of a pump stage. The labyrinth seal may reduce an amount of upthrust on the impeller from the pressurized fluid flowing therethrough. In certain embodiments, each pump stage can be coupled with other pump stages to increase dynamic lift of the centrifugal pump as required to meet the volumetric and total dynamic head requirements of each individual well. In such embodiments, labyrinth seals may be formed between an impeller and the diffusers on one or both sides of the impeller to reduce the amount of upthrust on the impeller from the pressurized fluid. The labyrinth seals and their effect on impeller upthrust in ESPs will be discussed in further detail below.

Figure 1:
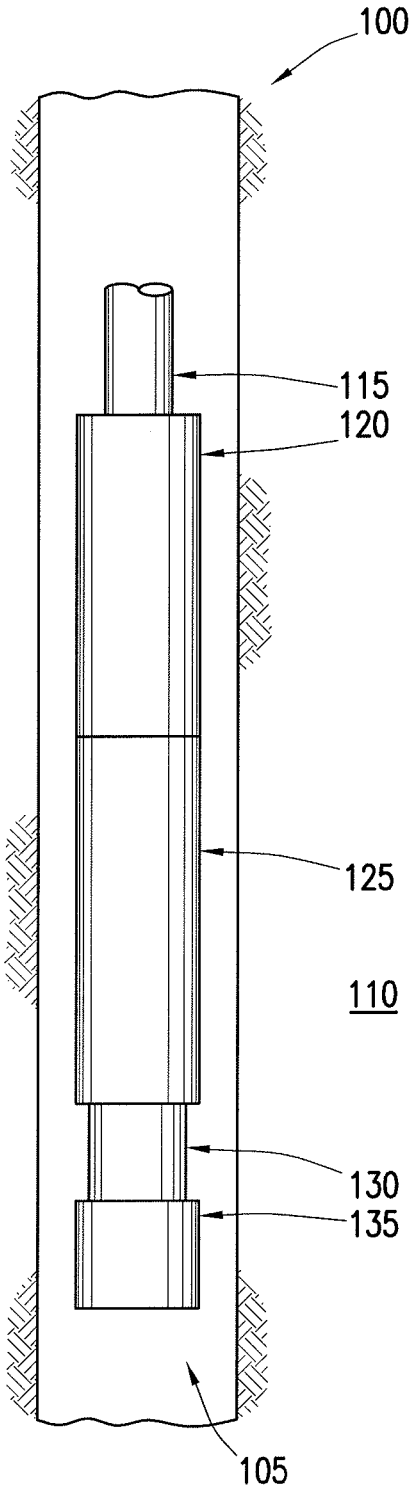
FIG. 1 is a schematic partial cross-sectional view of an electrical submersible pumping system, in accordance with an embodiment of the present disclosure.

Turning now to the drawings, FIG. 1 illustrates a schematic partial cross-sectional view of one example pumping system 100, in accordance with certain embodiments of the present disclosure. The pumping system 100 may be disposed within a wellbore 105, which may be cased or uncased according to a particular implementation, in a formation 110. The pumping system 100 may be an electrical submersible pump (ESP). The ESP may include a centrifugal pump 120 coupled to an intake section 125, a seal section 130, and a motor section 135. In general, the pumping system 100 may be suspended by a production tubular 115 in a suitable manner known in the art, with a submersible electrical cable extending from a power supply on the surface (not shown) to the motor of the motor section 135. The pump 120 may have one or more intakes in the vicinity of the intake section 125. The pump 120 may have a pump outlet located and attached for flow to a conduit for receiving pumped fluid in the vicinity of an upper end of the pump 120. From this upper end, the pump 120 may be connected to a conduit for carrying the fluid to the surface or into the casing of another submersible pump.

Figure 2:
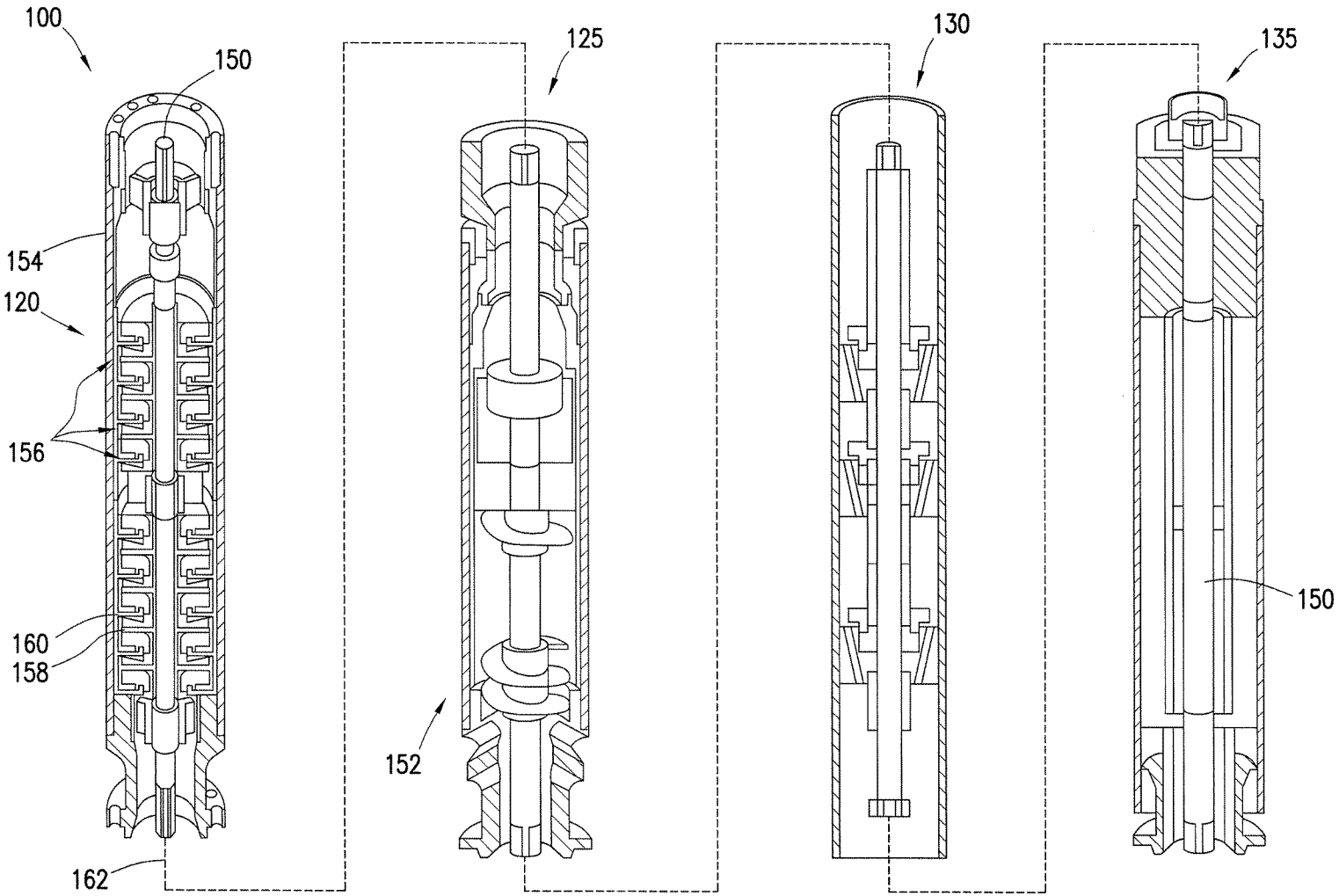
FIG. 2 is a schematic partial cross-sectional view of components of the pumping system of FIG. 1, in accordance with an embodiment of the present disclosure.

FIG. 2 is a schematic diagram illustrating in greater detail the components that make up the pumping system 100. More specifically, the illustrated pumping system 100 includes the pump 120 described above, the intake section 125, the seal section 130, and the motor section 135. As illustrated, each of these sections may be separate tool components that are coupled together axially to form the pumping system 100 described above. Each of these sections 120, 125, 130, and 135 is designed to carry out a specific function.

For example, the motor section 135 is used to convert electrical energy into mechanical energy to urge rotation of a shaft 150 extending at least partially through the pump 120. The seal section 130 includes a thrust bearing designed to cushion a downward thrust (downthrust) output from the pump 120 to the lower components of the pumping system 100. In this manner, the seal section 130 functions as a protector for the lower portions of the pumping system 100. In some embodiments, the intake section 125 may include a gas separator 152 used to ensure that relatively little gas travels through the pump 120 and up to the surface.

As illustrated, the pump 120 includes a pump housing 154, the shaft 150, and several pump stages 156 that are stacked one over the other along the length of the pump 120. Each of the pump stages 156 is made up of an impeller 158 and a diffuser 160. The impellers 158 are coupled to the shaft 150 and are designed to rotate as rotors relative to the diffusers 160. The diffusers 160 remain stationary with respect to the pump housing 154, and the motor section 135 rotates the shaft 150 to rotate the impellers 158, which pump fluids through the pumping system 100. In certain embodiments, the motor section 135 may rotate the impellers 158 relative to the diffusers 160 at a speed of approximately 3600 revolutions per minute, although this speed could be higher or lower. As the impellers 158 rotate, they pressurize downhole fluids, urging them up the pump through passages formed into the impellers 158 and the diffusers 160. Specifically, each rotating impeller draws the fluid up through fluid passages in the impeller and directs the fluid into fluid passages of the downstream diffuser.

In the pump 120, one or more impellers 158 may be designed to move up and down relative to the diffusers 160 along a direction of the axis 162. This movement may be based on a number of different forces being applied to the impellers 158. For example, certain forces applied to an impeller 158 in a downward (e.g., upstream) direction may exert a downward thrust (downthrust) on the impeller 158, thereby pushing the impeller 158 downward. Such downward forces may include a force acting on the impeller 158 due to gravity as well as a pressure differential between the lower pressure upstream end of the impeller 158 and the higher pressure downstream end of the impeller 158. Similarly, certain forces applied to the impeller 158 in an upward (e.g., downstream) direction may exert an upthrust on the impeller 158, pushing the impeller 158 upward. Such upward forces may come from the momentum of the pressurized fluid flowing upward through the passages of the impeller 158, as well as the pressure differential.

It is desirable to maintain a particular balance between the upthrust and downthrust forces on the impellers 158 of the pump 120, in order to increase the efficiency of operation of the ESP. For example, it may be desirable to maintain the impellers 158 in a slight net downthrust condition relative to the diffusers 160 such that each impeller 158 is forced downward toward the next upstream diffuser 160 in the pump 120. In other embodiments, the impellers 158 may be in a no net thrust condition relative to the diffusers 160, such that the forces on the impeller 158 are balanced and the impeller 158 does not directly contact either one of its neighboring diffusers 160. The net downthrust condition is acceptable because the pumping system 100 includes the seal section 130, which as noted above includes a thrust bearing configured to dissipate any additional downward forces received from the pump 120 (e.g., due to downthrust). For example, the protector thrust bearing within the seal section 130 may be able to handle up to 12,000 lbs of force in the downward direction. However, the only component in conventional centrifugal pumping systems able to dissipate upthrust forces are individual washers disposed on the impellers 158. These washers do little to dissipate the forces applied thereto when the impeller 158 is thrust up against the downstream diffuser 160, and as a result they wear out relatively quickly. Accordingly, in order to maximize the lifetime of the pumping system 100, it is desirable to maintain the impellers 158 in a net downthrust or no net thrust condition so the impellers 158 do not contact the downstream diffusers 160. As discussed in detail below, present embodiments of the pumping system 100 include pump stages 156 that utilize labyrinth seals to balance out the upthrust forces on the impellers 158.

Figure 4:
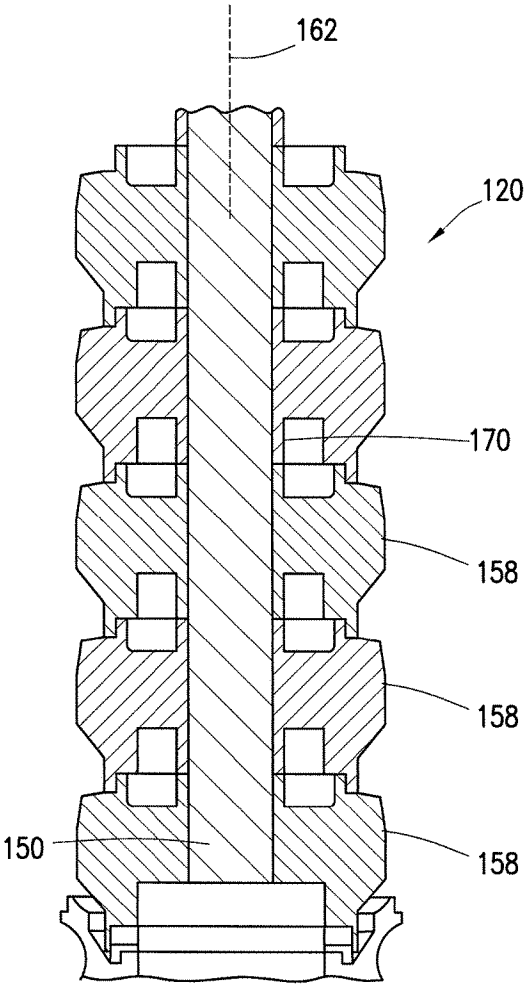
FIG. 4 is a cross-sectional view of a plurality of pump stages of the pumping system of FIG. 2 in a compression configuration, in accordance with an embodiment of the present disclosure.
Figure 3:
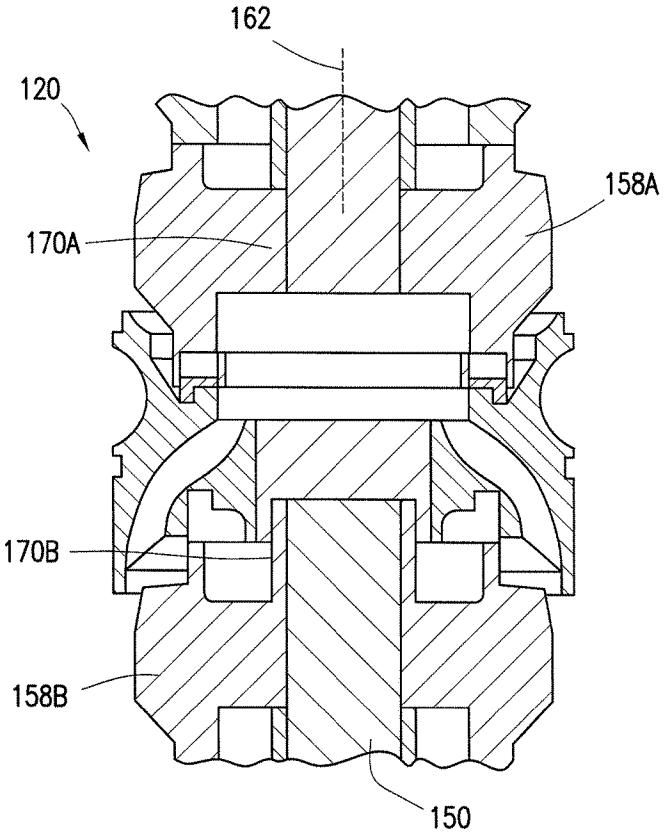
FIG. 3 is a cross-sectional view of two pump stages of the pumping system of FIG. 2 in a float configuration, in accordance with an embodiment of the present disclosure.
Figure 5:
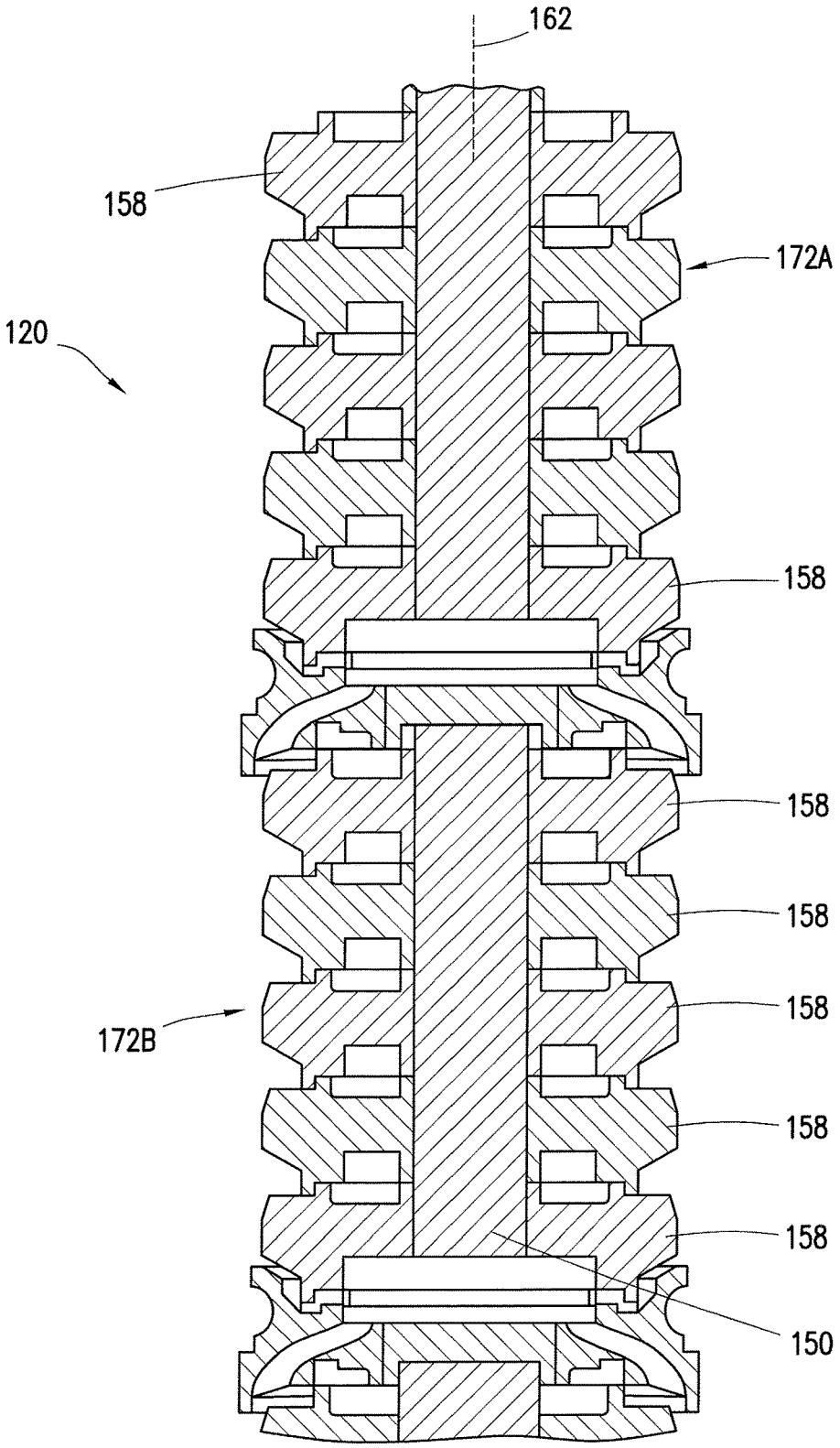
FIG. 5 is a cross-sectional view of a plurality of pump stages of the pumping system of FIG. 2 in a hybrid configuration having pump stages divided into groups, each group being in a compression design with a float configuration between each of the groups, in accordance with an embodiment of the present disclosure.

FIGS. 3-5 illustrate three different configurations of the pump 120 that may employ the disclosed labyrinth seals between the impellers 158 and their respective diffusers 160. FIG. 3 shows the pump 120 in a float configuration, where a hub 170A of one impeller 158A is not in contact with a hub 170B of the adjacent impeller 158B. In this configuration, one impeller 158A may move up and down along the axis 162 of the shaft 150 without the other impeller 158B moving in the same way. FIG. 4 shows the pump 120 in a compression configuration, where the hubs 170 of each of the impellers 158 of the pump 120 are in contact with one another along the length of the pump 120. In this configuration, all of the impellers 158 move up and down along the axis 162 of the shaft together relative to the diffusers 160.

FIG. 5 shows the pump 120 in a hybrid configuration, where the hubs 170 of some adjacent impellers 158 are in contact with each other while the hubs 170 of other adjacent impellers 158 are not in contact with each other. For example, the pump 120 may include a first group 172A of the impellers 158 with hubs all contacting one another. There may be multiple groups (e.g., 172A and 172B) each with the same number of impellers 158 in a compression configuration. Between each of these groups 172A and 172B, the hubs 170 of adjacent impellers 158 are not in contact. Thus, the hybrid configuration illustrated in FIG. 5 is a hybrid version of the pump stage configurations shown in FIGS. 3 and 4. As noted above, any of the above described pump stage configurations (e.g., float, compression, or hybrid) may utilize the disclosed labyrinth seals disposed between the impellers 158 and diffusers 160.

Figure 6:
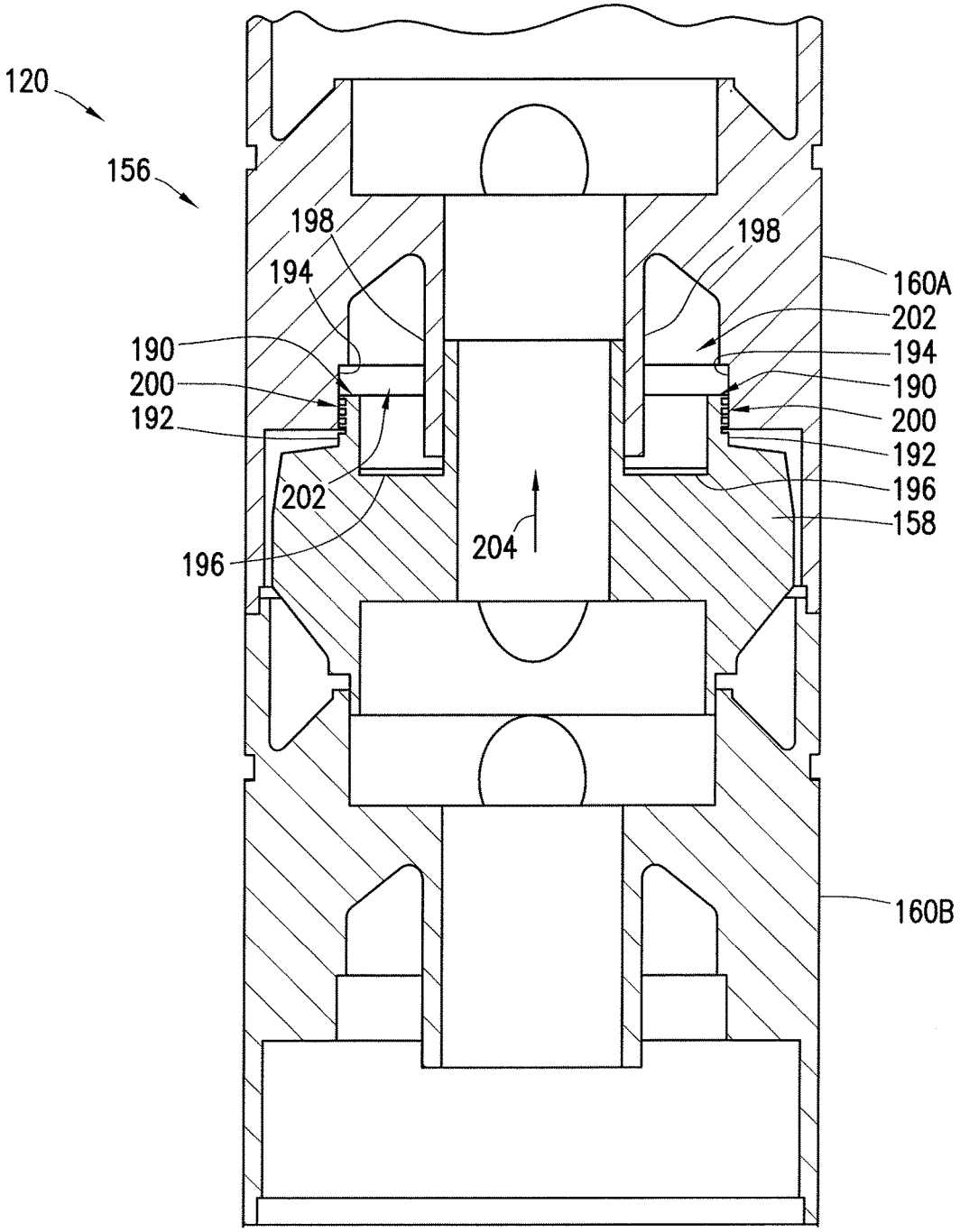
FIG. 6 is a cross sectional view of impellers and diffusers of the pumping system of FIG. 2, the illustrated impeller having a labyrinth seal in accordance with an embodiment of the present disclosure.

FIG. 6 is a cross sectional view of an embodiment of certain components of the pump 120. More specifically, the illustrated pump 120 includes one impeller 158 disposed between two adjacent diffusers 160A and 160B. The impeller 158 and the diffuser 160A disposed above the impeller 158 may form one of the pump stages 156 of the pump 120. The impeller 158 includes a balance ring 190 formed along a portion of the impeller 158 that interfaces with the diffuser 160A. The balance ring 190 includes an upwardly extending outer edge 192 that is disposed in close proximity with, but not touching, a corresponding downwardly extending inner edge 194 of the diffuser 160A.

As illustrated, a washer 196 may be pressed into a lower portion of the balance ring 190. The washer 196, which may be a phenolic washer, is used to absorb forces caused by the pump stage 156 running in an upthrust condition. That is, if the force on the impeller 158 in an upward direction is greater than the force on the impeller 158 in a downward direction, the impeller 158 may move upward and into contact with the diffuser 160A. In the illustrated embodiment, this contact would occur between a hub 198 of the diffuser 160A and the washer 196 on the impeller 158. Such contact between the impeller 158 and the diffuser 160A may lead to undesirable wear on the washer 196, thereby reducing the pump lifetime.

Figure 7:
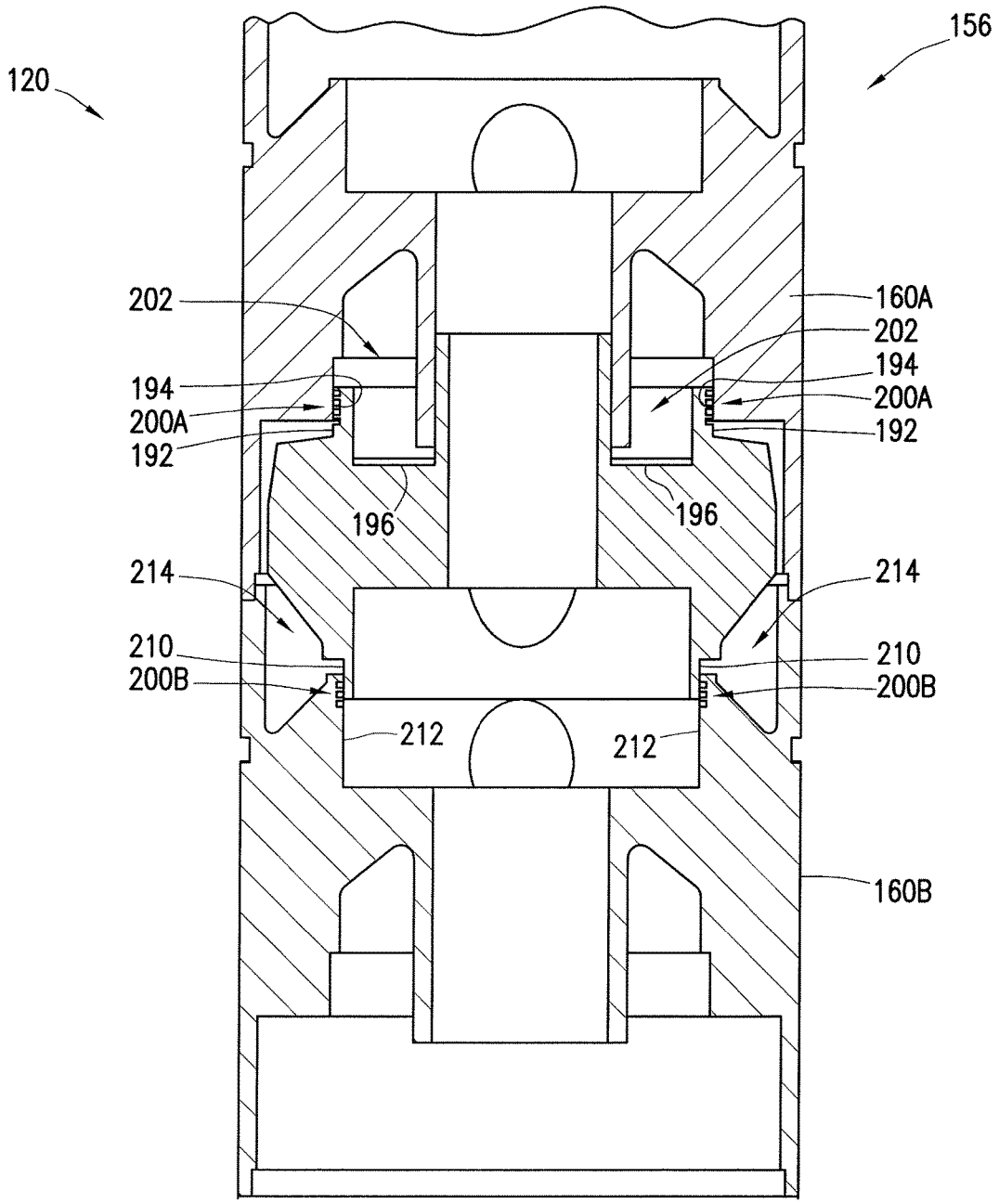
FIG. 7 is a cross sectional view of impellers and diffusers of the pumping system of FIG. 2, the illustrated diffuser having a labyrinth seal in accordance with an embodiment of the present disclosure.

As noted above, the pump 120 includes a labyrinth seal 200 positioned between the impeller 158 and the corresponding diffuser 160A to reduce the upward movement of the impeller 158 relative to the diffuser 160A. In the illustrated embodiment, the labyrinth seal 200 is formed into the balance ring of the impeller 158, specifically positioned along the upwardly extending outer edge 192 that faces the downwardly extending inner edge 194 of the diffuser 160A. In other embodiments, the labyrinth seal 200 may be formed into an inner edge of the impeller 158 facing a corresponding outer edge of the diffuser 160A. It should also be noted that, in other embodiments, the labyrinth seal 200 may be formed into the diffuser 160A (e.g., along the edge 194) instead of the impeller 158, as illustrated in FIG. 7. In still further embodiments, the labyrinth seal 200 may be formed into both the impeller 158 and the diffuser 160A.

The labyrinth seal 200 is a series of grooves formed into the impeller 158 (and/or the diffuser 160A) that provides a circuitous path between the impeller 158 and the diffuser 160A so that leakage of fluid through the labyrinth seal 200 is reduced or eliminated. As fluid flows toward the labyrinth seal 200, the fluid may form vortexes within the grooves of the labyrinth seal 200. This prevents the fluid from passing through the seal toward the next groove and eventually out of the seal.

In present embodiments, the labyrinth seal 200 provides such a tortuous path between a fluid passage of the pump stage 156 (e.g., an impeller passage) and a cavity 202 formed between the impeller 158 and the diffuser 160A. As the net forces on the impeller 158 reach an upthrust condition, pushing the impeller 158 toward the diffuser 160A (as shown by an arrow 204), the labyrinth seal 200 seals the cavity 202 off from the fluid passage. Thus, pressurized fluid that previously entered the cavity 202 cannot flow out of the cavity through the labyrinth seal 200. As a result, the fluid trapped in the cavity 202 presses downward against the impeller 158, balancing the forces on the impeller 158 so that the impeller 158 does not come into direct contact with the diffuser 160A. In this manner, the labyrinth seal 200 seals the impeller passage from the cavity 202 to maintain the impeller 158 in a stable, floating condition relative to the diffuser 160A.

In the illustrated embodiment, the labyrinth seal 200 includes four grooves each with a square or rectangular profile formed into the impeller 158. However, it should be noted that different types and numbers of grooves may be utilized as labyrinth seals 200 in other embodiments. For example, the labyrinth seal 200 may include an increased or decreased number of grooves between the impeller 158 and the diffuser 160A (e.g., 2, 3, 5, 6, 7, 8, 9, 10, or more grooves). In some embodiments, the impeller 158 may be formed so that the upwardly extending edge 192 of the balance ring 190 (and/or downwardly extending edge 194 of the diffuser 160A) is longer than in the illustrated embodiment in order to accommodate an increased number of labyrinth seal grooves. In addition, the labyrinth seal 200 may include any desirable shape of grooves formed into the impeller 158, the diffuser 160A, or both. These different shapes of grooves may include at least square (as illustrated), rectangular, round, helical, threaded, or some other design. In embodiments where a threaded labyrinth seal 200 is provided, the labyrinth seal 200 may include corresponding threaded grooves formed in both the impeller 158 and the diffuser 160A.

The disclosed labyrinth seal 200 reduces the possibility of the impeller 158 coming into direct contact with the diffuser 160A as a result of an upthrust condition. This may increase the stability of operation and the efficiency of the pump stage 156 since no impacts occur between the impeller 158 and the diffuser 160A. In addition, the labyrinth seal 200 may extend the overall lifespan of the pump 120, since the washer 196 does not have to endure the wear it would if the labyrinth seal 200 was not present. Further, the labyrinth seal 200 may be formed into an already existing portion of the impeller 158 and/or the diffuser 160A, making it relatively easy to manufacture.

It may be desirable to maintain the impeller 158 in a slight downthrust condition relative to both the diffuser 160A above the impeller as well as the diffuser 160B below the impeller. Even though the pump 120 generally includes the seal section 130 (shown in FIG. 2) for absorbing any force in the downward direction due to a net downthrust on the impellers 158 of the pump 120, reducing this downthrust may be desirable in order to maintain the seal section for longer than would be available using a conventional pump. To that end, FIG. 8 illustrates an embodiment of the pump 120 having two labyrinth seals 200A and 200B, one between the impeller 158 and the upper diffuser 160A and the other between the impeller 158 and the lower diffuser 160B.

Figure 8:
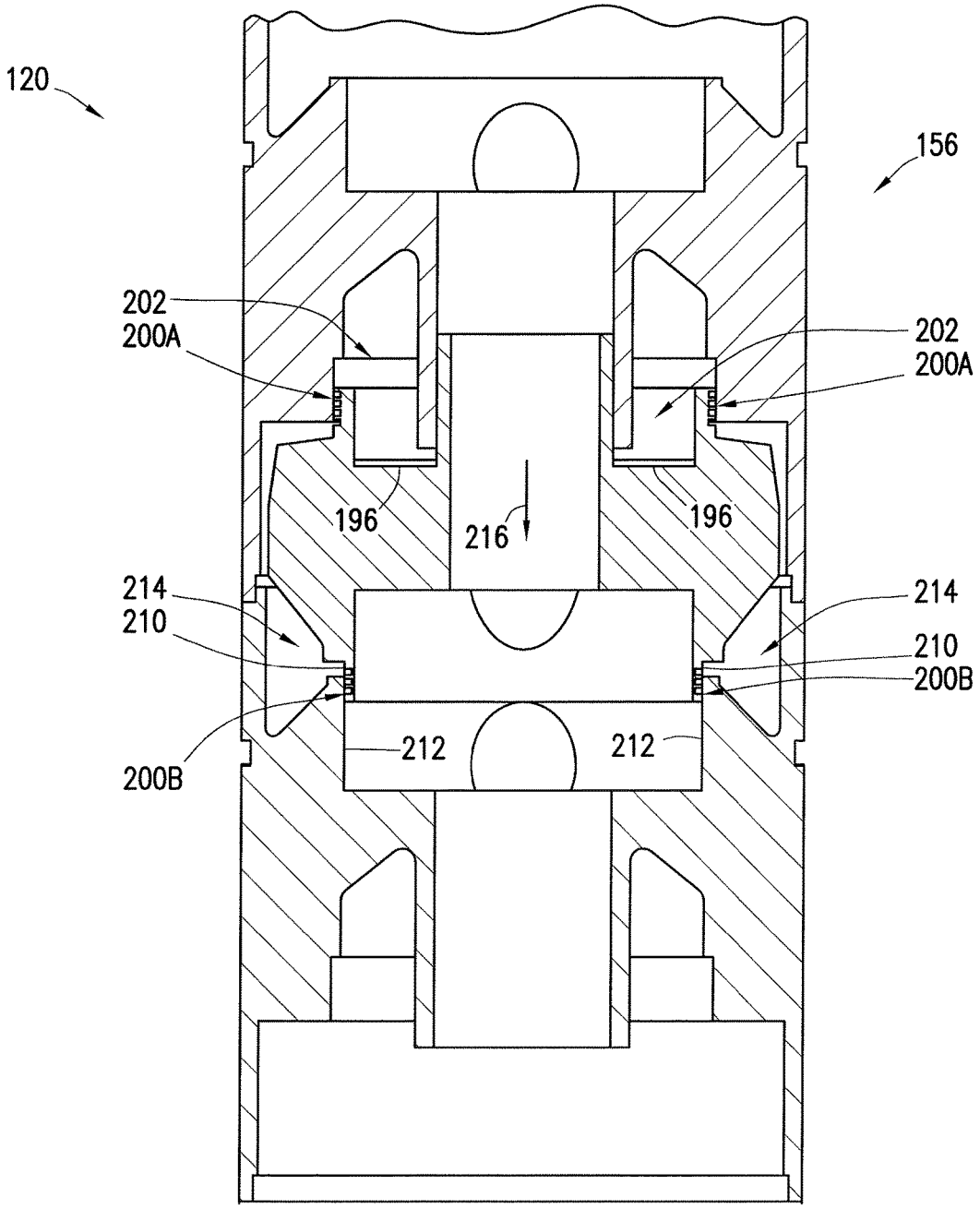
FIG. 8 is a cross sectional view of impellers and diffusers of the pumping system of FIG. 2, the illustrated impeller having two labyrinth seals in accordance with an embodiment of the present disclosure.

In FIG. 8, the upper labyrinth seal 200A is formed between the impeller 158 and the diffuser 160A, while the lower labyrinth seal 200B is formed between the impeller 158 and the diffuser 160B. Both of the labyrinth seals 200A and 200B, in the illustrated embodiment, are formed into extensions of the impeller 158. However, it should be noted that one or both of the labyrinth seals 200A and 200B may be formed directly into the diffusers 160A and 160B, respectively, as illustrated in FIG. 7. This two-seal configuration is particularly useful in the context of pumping downhole fluids through an ESP since the pump 120 is generally aligned and maintained in a vertical orientation, so that the pump 120 can compensate for downthrust conditions of the impeller 158 due to gravity.

The labyrinth seal 200B at the bottom may be formed between similar components of the impeller 158 and/or the diffuser 160B as the above labyrinth seal 200A. For example, the labyrinth seal 200B may be formed into a downwardly extending outer edge 210 of the impeller 158, adjacent a corresponding upwardly extending inner edge 212 of the diffuser 160B. In other embodiments, however, the labyrinth seal 200B may be formed into an inner edge of the impeller 158 adjacent a corresponding outer edge of the diffuser 160B.

The labyrinth seal 200B may separate a fluid passage of the pump 120 from a cavity 214 formed between the impeller 158 and the diffuser 160B. Thus, the labyrinth seal 200B provides a tortuous path between the fluid passage and the cavity 214. As the net forces on the impeller 158 reach a downthrust condition, pushing the impeller 158 toward the diffuser 160B (as shown by arrow 216), the labyrinth seal 200B seals the cavity 214 off from the fluid passage. Thus, pressurized fluid that previously entered the cavity 214 cannot flow out of the cavity through the labyrinth seal 200B. The fluid trapped in the cavity 214 presses upward against the impeller 158, balancing the forces on the impeller 158 so that the impeller 158 does not come into direct contact with the diffuser 160B. In this manner, the labyrinth seal 200B seals the impeller passage from the cavity 214 to maintain the impeller 158 in a stable, floating condition relative to the diffuser 160B.

When two labyrinth seals 200A and 200B are utilized, as in FIG. 8, the labyrinth seals 200A and 200B may be configured to balance the net forces on the impeller 158 such that the impeller 158 does not come into contact with either of the two adjacent diffusers 160A and 160B. When the impeller 158 is in a downthrust condition, based on the forces applied thereto, the impeller 158 moves downward. As this happens, the labyrinth seal 200A moves downwards relative to the stationary diffuser 160A. As a result of this movement, some of the fins that define the grooves of the labyrinth seal 200A may become exposed to the fluid passageway, being no longer directly across from the diffuser 160A. In addition, the fins of the labyrinth seal 160A may bend slightly, thereby breaking the seal caused by the labyrinth seal 200A and releasing the downthrust condition. The fluid from the cavity 202 that would otherwise be pushing downward on the impeller 158 is released to the passage of the pump 120, reducing at least a portion of the downward force on the impeller 158. At the same time, the other labyrinth seal 200B is sealing off the cavity 214 from the passages of the pump 120 so that fluid within the cavity 214 exerts an upward force on the impeller 158.

Figure 9:
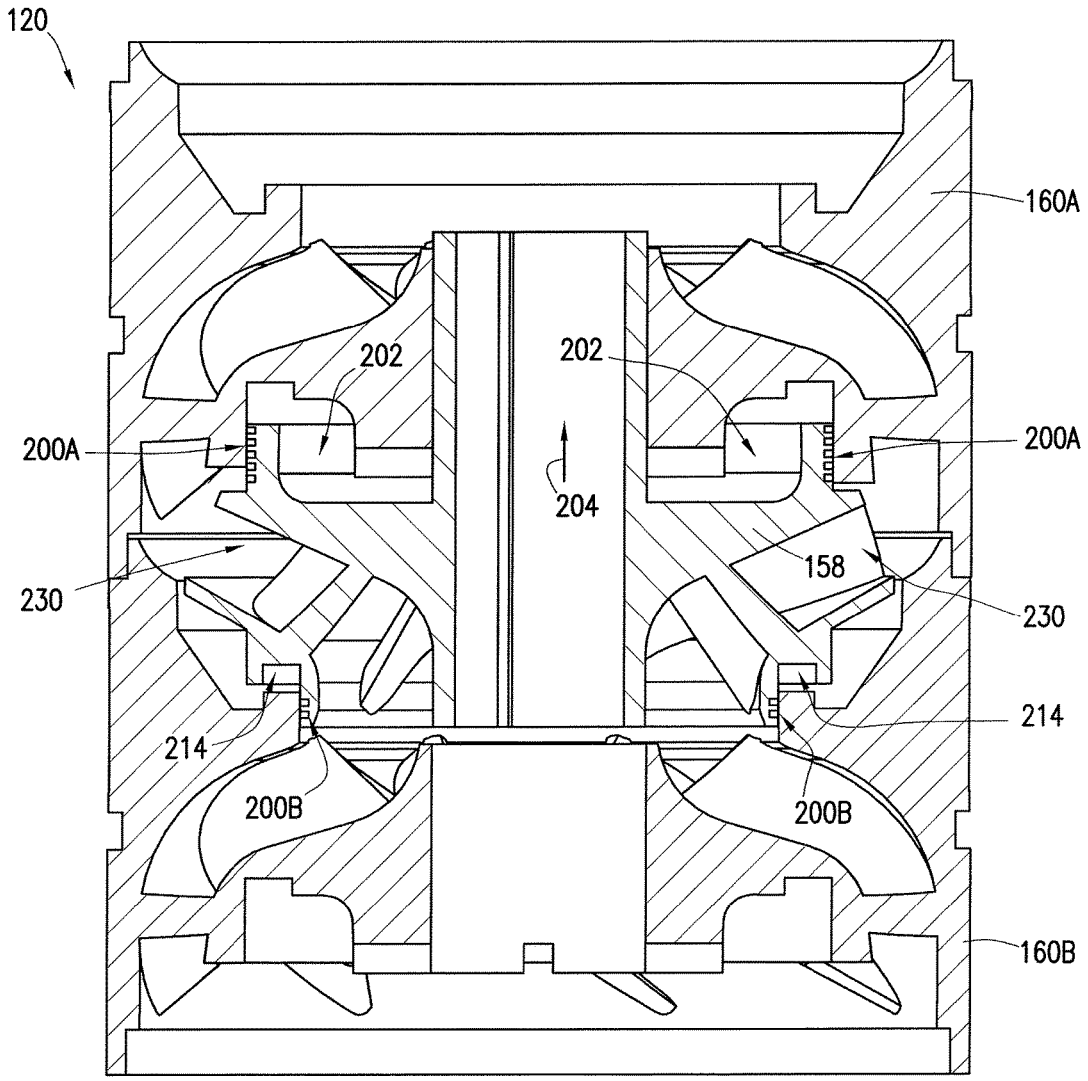
FIG. 9 is a cross sectional view of an impeller in the upthrust position relative to two diffusers of FIG. 2, in accordance with an embodiment of the present disclosure.

A more detailed view of an embodiment of the pump 120 with two labyrinth seals 200A and 200B on a single impeller 158 is shown in FIG. 9 in an upthrust condition. When the impeller 158 is in the upthrust condition, the impeller 158 moves upward (as shown by the arrow 204). Consequently, the labyrinth seal 200B moves upwards relative to the stationary diffuser 160B. As a result of this movement, some of the fins of the labyrinth seal 200B may become exposed to a fluid passageway 230, since they are no longer directly across from the diffuser 160B. Any of the fins of the labyrinth seal 160B that are not exposed to the passageway 230 may bend slightly, thereby breaking the seal caused by the labyrinth seal 200B and releasing the upthrust condition. The fluid from the cavity 214 that would otherwise be pushing upward on the impeller 158 is released to the passageway 230 of the pump 120, reducing at least a portion of the upward force on the impeller 158. At the same time, the upper labyrinth seal 200A is sealing off the cavity 202 from the passageway 230 of the pump 120 so that fluid within the cavity 202 exerts a downward force on the impeller 158. The passageway 230 may include a fluid passage through the impeller 158 and corresponding fluid passages through the diffusers 160A and 160B.

It should be noted that different arrangements or combinations of the disclosed labyrinth seals 200 may be implemented in different embodiments of the presently disclosed pump 120. For example, in some pumps 120, the labyrinth seal 200B may formed between the impeller 158 and the diffuser 160B below the impeller 158, without the above labyrinth seal. In other embodiments, the labyrinth seal 200A may be present between the impeller 158 and the diffuser 160A above the impeller 158, without the below labyrinth seal. In still further embodiments, both labyrinth seals 200A and 200B may be present, as illustrated in FIGS. 8 and 9. It may be desirable to at least include the labyrinth seal 200A at the top of the impeller 158, in order to seal off the cavity 202 and thus keep the top of the impeller 158 from impacting the diffuser 160A. However, any desirable combination may be utilized and configured to provide the desired force balance to the impeller 158.

As illustrated in FIGS. 8 and 9, embodiments of the pump 120 having two labyrinth seals 200A and 200B for a given impeller 158 may have different numbers of grooves for the different labyrinth seals 200A and 200B. For example, in both illustrated embodiments, the labyrinth seal 200A between the impeller 158 and the above diffuser 160A is longer and has a greater number of grooves than the labyrinth seal 200B between the impeller 158 and the below diffuser 160B. This may be because a net upthrust generally occurs when the flow rate of the fluid through the impeller 158 is higher than the pump 120 was designed to handle, and therefore a more robust seal is desirable at the upper portion of the impeller 158. This may also be because a net upthrust is less desirable from a lifetime standpoint, since the washer 196 used to absorb the upward impact forces wears out more quickly than the seal section 130 (shown in FIG. 2) of the pump 120 used to absorb the downward impact forces. Thus, any desirable number of grooves may be used to form the labyrinth seals 200A and 200B at the top and bottom of the impeller 158, and these numbers may be the same or different between the two labyrinth seals 200A and 200B, based on the expected forces and the desired net thrust on the impeller 158.

Figure 10:
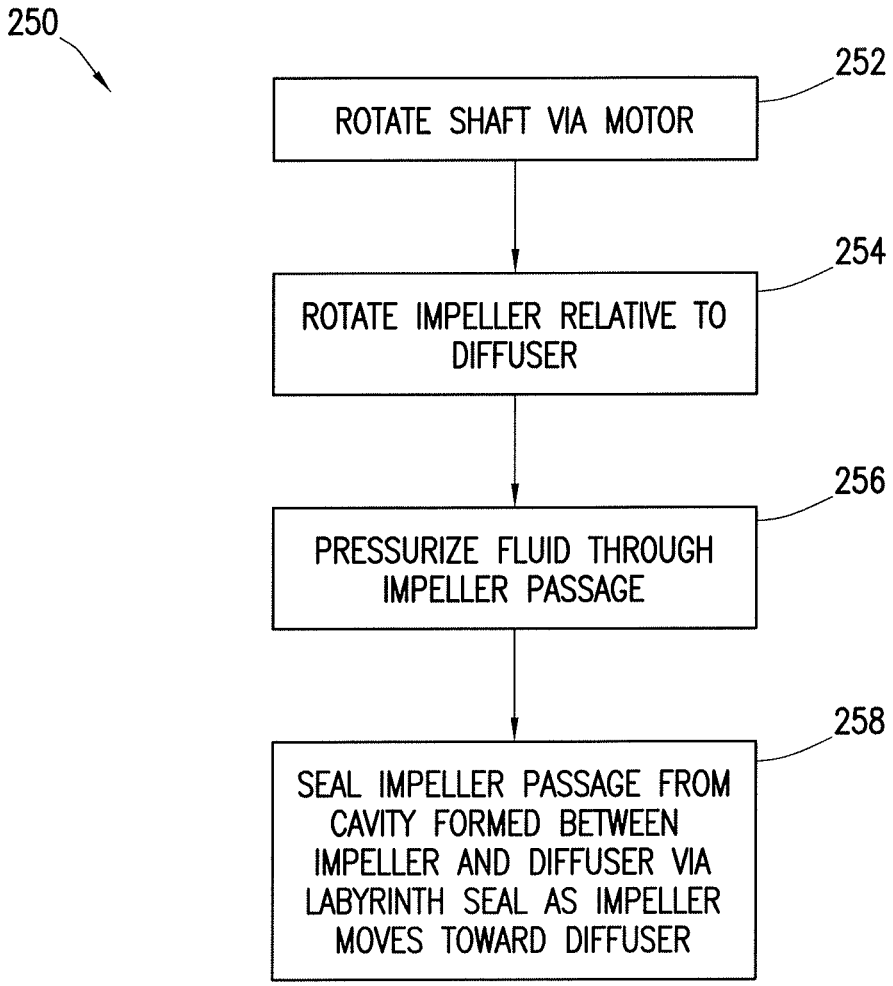
FIG. 10 is a process flow diagram of a method of operating the pumping system of FIG. 2, in accordance with an embodiment of the present disclosure.

FIG. 10 is a process flow diagram illustrating a method 250 of operating the pumping system 100 (e.g., ESP) disclosed in FIGS. 1-9 above. The method 250 includes rotating (block 252) the shaft via the motor section and, as a result, rotating (block 254) the impeller relative to the diffuser to urge fluid through the impeller passage of the impeller and into a corresponding diffuser passage of the diffuser. The method 250 also includes pressurizing (block 256) fluid flowing through the impeller passage via the impeller. Further, the method 250 includes sealing (block 258) the impeller passage from a cavity formed between the impeller and the diffuser via the labyrinth seal when the impeller moves toward the diffuser in an axial direction of the shaft. This applies both when the impeller is in an upthrust condition moving toward the diffuser above the impeller and when the impeller is in a downthrust condition moving toward the diffuser below the impeller. Indeed, as described above, the method may apply to an impeller with two labyrinth seals between the impeller and the diffusers on either side.

Although the present disclosure and its advantages have been described in detail, it should be understood that various changes, substitutions and alterations can be made herein without departing from the spirit and scope of the disclosure as defined by the following claims.

What is claimed is:

1. An electrical submersible pump, comprising:

a pump housing;

a shaft extending at least partially through the pump housing and adapted to be driven by a submersible motor;

an impeller attached to the shaft and having an impeller passage for fluid to flow therethrough;

a diffuser that is stationary relative to the pump housing and having a diffuser passage, wherein the diffuser is disposed corresponding to the impeller to form a pump stage such that fluid can flow between the impeller passage and the diffuser passage; and a labyrinth seal disposed between the impeller and the diffuser, the labyrinth seal forming a seal between the impeller passage from a cavity formed between the impeller and the diffuser to maintain the impeller in a floating condition relative to the diffuser.

2. The electrical submersible pump of claim 1, wherein the labyrinth seal is formed into an edge of the impeller extending toward the diffuser.

3. The electrical submersible pump of claim 1, wherein the labyrinth seal is formed into an edge of the diffuser extending toward the impeller.

4. The electrical submersible pump of claim 1, wherein the labyrinth seal comprises a plurality of grooves formed into the impeller, the diffuser, or both.

5. The electrical submersible pump of claim 4, wherein the plurality of grooves have a rectangular shaped profile.

6. The electrical submersible pump of claim 4, wherein the plurality of grooves have a helical profile.

7. The electrical submersible pump of claim 1, wherein the diffuser is disposed downstream of the impeller and the labyrinth seal is formed between an upper portion of the impeller and a lower portion of the diffuser.

8. The electrical submersible pump of claim 1, wherein the diffuser is disposed upstream of the impeller and the labyrinth seal is formed between a lower portion of the impeller and an upper portion of the diffuser.

9. The electrical submersible pump of claim 1, comprising a plurality of alternating impellers and diffusers forming a plurality of pump stages connected in series, wherein at least one pump stage comprises a first labyrinth seal to maintain the corresponding impeller in a floating condition relative to the corresponding diffuser.

10. The electrical submersible pump of claim 9, comprising a second labyrinth seal formed between the impeller of the at least one pump stage and a diffuser of an adjacent pump stage to maintain the impeller of the at least one pump stage in a downthrust condition relative to the diffuser of the adjacent pump stage.

11. The electrical submersible pump of claim 9, wherein the plurality of pump stages are arranged in a float configuration, a compression configuration, or a hybrid configuration.

12. The electrical submersible pump of claim 1, wherein the impeller is not in direct contact with the diffuser during operation of the electrical submersible pump.

13. An electrical submersible pump, comprising:

a pump housing;

a shaft extending at least partially through the pump housing and adapted to be driven by a submersible motor;

an impeller attached to the shaft and having an impeller passage for fluid to flow therethrough;

a diffuser disposed above and corresponding to the impeller to form a pump stage; and a first labyrinth seal disposed between an upwardly extending edge of the impeller and a downwardly extending edge of the diffuser, the labyrinth seal forming and maintaining a seal between the impeller passage and a cavity between the impeller and the diffuser when the impeller is in an upthrust condition, and the labyrinth seal releasing the seal between the impeller passage and the cavity when the impeller is in a downthrust condition.

14. The electrical submersible pump of claim 13, wherein the labyrinth seal is formed on the upwardly extending edge of the impeller.

15. The electrical submersible pump of claim 13, wherein the labyrinth seal is formed on the downwardly extending edge of the diffuser.

16. The electrical submersible pump of claim 13, comprising a second diffuser disposed below and corresponding to the impeller; and a second labyrinth seal disposed between a downwardly extending edge of the impeller and an upwardly extending edge of the second diffuser, the second labyrinth seal maintaining a seal between the impeller passage and a lower cavity formed between the impeller and the second diffuser when the impeller is in the downthrust condition, and releasing the seal between the impeller passage and the lower cavity when the impeller is in the upthrust condition.

17. The electrical submersible pump of claim 13, wherein the first labyrinth seal prevents the impeller from applying an increasing force to the diffuser during operation of the electrical submersible pump.

18. The electrical submersible pump of claim 13, wherein the labyrinth seal comprises a plurality of grooves formed into the impeller, the diffuser, or both to provide a circuitous path between the impeller passage and the cavity.

19. A method of operating a electrical submersible pump, comprising:

rotating a shaft of the electrical submersible pump via a submersible motor;

rotating an impeller relative to a diffuser via the rotating shaft to urge fluid through an impeller passage of the impeller and into a corresponding diffuser passage of the diffuser;

pressurizing the fluid through the impeller passage via the impeller; and sealing the impeller passage from a cavity formed between the impeller and the diffuser via a labyrinth seal formed between the impeller and the diffuser when the impeller moves toward the diffuser in an axial direction of the shaft.

20. The method of claim 19, comprising:

rotating the impeller relative to a first diffuser on one side of the impeller and a second diffuser on an opposite side of the impeller to urge fluid from a diffuser passage of the first diffuser through the impeller passage to a diffuser passage of the second diffuser;

sealing the impeller passage from a first cavity formed between the impeller and the first diffuser via a first labyrinth seal formed between the impeller and the first diffuser, when the impeller is a first threshold distance away from the first diffuser in the axial direction; and sealing the impeller passage from a second cavity formed between the impeller and the second diffuser via a second labyrinth seal formed between the impeller and the second diffuser, when the impeller is a second threshold distance away from the second diffuser in the axial direction.

* * * * *